United States Patent [19]

Yasuoka et al.

[11] Patent Number: 4,678,511

[45] Date of Patent: Jul. 7, 1987

[54] SPRAY MICROPELLETS

[75] Inventors: Junichi Yasuoka; Sumio Kamiyama; Kiyomi Ashida; Ryozo Hata, all of Uji, Japan

[73] Assignee: Awamura Metal Industry Co., Ltd., Kyoto, Japan

[21] Appl. No.: 772,942

[22] Filed: Sep. 5, 1985

[30] Foreign Application Priority Data

Sep. 8, 1984 [JP] Japan ..... 59-188582

[51] Int. Cl.[4] ..... B22F 1/02

[52] U.S. Cl. ..... 75/251; 75/252; 75/254; 75/255

[58] Field of Search ..... 75/251, 252, 254, 255; 428/570, 546

[56] References Cited

U.S. PATENT DOCUMENTS

| | | | |
|---|---|---|---|
| 3,254,970 | 6/1966 | Dittrich et al. | 428/570 |
| 3,556,747 | 1/1971 | Hyde et al. | 78/252 |
| 3,617,358 | 11/1971 | Dittrich et al. | 117/105.2 |
| 3,758,124 | 9/1973 | Weinberger et al. | 277/2.24 |
| 4,387,140 | 6/1983 | Kondo et al. | 428/553 |
| 4,395,279 | 7/1983 | Houch | 75/0.5 BB |
| 4,420,543 | 12/1983 | Kondo et al. | 428/564 |
| 4,507,151 | 3/1985 | Simm et al. | 75/251 |

*Primary Examiner*—Christopher W. Brody
*Attorney, Agent, or Firm*—Wenderoth, Lind & Ponack

[57] ABSTRACT

The present invention provides improved spray micropellets having a particle size of 5–150 μm mainly composed of micropellets of high carbon ferrochrome alloy fine powder having an average particle of 0.5–20 μm, mainly containing Cr 20–80 wt. %, Fe 15–75 wt. %, C 5–10 wt. %, Si less than 10 wt. % and Ti and Mn as unavoidable impurities.

The spray micropellets are particularly useful for sliding parts having high sealing effects such as pistons and the like.

17 Claims, 11 Drawing Figures

SPRAY MICROPELLETS

Figure 2:
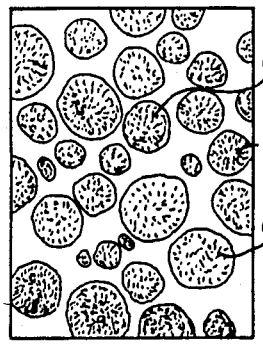
FIGS. 2, 3, 4, 5, 6, 7, 8 and 9 are views of examples of spray powders of this invention.

The following reference numerals designate the following elements:

1. Lapping surface.
2. 2'. Sprayed coatings.
3. Substrate.
4. 4'. High hardness particles.
5. Micropelletized micropellets which are mixed fine powders of high carbon ferrochrome alloy 70% with fine powders of SFA 15%.
6. Coarse powders of nickel-aluminide.
7. Coarse powders of SFA.
8. Micropellets of fine powders of Mo.
9. One kind of micropelletized micropellets which are mixed fine powders of high carbon ferrochrome alloy 70% with fine powders of SFA 30%.
10. Spray powders composed of one kind of micropelletized micropellets which are mixed fine powders of high carbon ferrochrome alloy 70% with fine powders of Mo 15%.
11. Micropelletized micropellets which are mixed fine powders of high carbon ferrochrome alloy 70% with fine particles of Mo 15%.
12. Micropelletized micropellets of fine powders of high carbon ferrochrome alloy.

DETAILED DESCRIPTION OF THE INVENTION (Industrial utilization and prior art)

This invention concerns spray micropellets in which said micropellets are composed of high carbon ferrochrome alloys (Cr 20–80%, Fe 15–75%, C 5–10%, Si less than 10% and other unavoidable impurities such as Ti and Mn etc.— and said components are all the same hereinafter) as a main component and which is micropelletized, and said spray micropellets have a good sealing effect and high wear resistance and are used for sliding parts, especially for mechanical seals.

Spray materials heretofore in use which contain pulverized high hardness materials are coarse due to these high hardness particles and have such defects as many pores and cracks etc in coatings in plasma spraying; therefore particles disconnected from sliding interface have defects which increase abrasive wear to the sliding interface, thus increasing surface roughness at lapping due to the large difference in hardness between the high hardness material and the matrix, and these sprayed micropellets are not suitable as sealing materials, especially for mechanical seals.

Many mechanical seals are manufactured by setting sintered materials such as cemented carbides and ceramics in stainless steel until now, but in this case, severe conditions are imposed on the dimensional accuracy and on other factors.

For the solution of the above problems, the inventors have concentrated their effort on producing sliding parts having high wear resistance by plasma spraying of materials taking into account the defects of spraying materials currently in use in which high carbon ferrochrome alloys were present, and have succeeded in producing finely pulverized and micropelletized high carbon ferrochrome alloys. It was very difficult and unsuitable to use spray materials which remained as fine powders. (see FIG. 11)

In our invention SFA or AF metals were formed into a matrix containing high carbon ferrochrome alloy in the sprayed coatings and Mo can be added to increase scuffing resistance. (SFA or AF metals are described later on.)

This invention is summarized in Table 1. However, this invention is not limited to the compositions shown in Table 1. For instance, ceramics and other metals can be used as spray micropellets in this invention illustrated in Table 1.

Note: In Table 1.

Fe-Cr represents high carbon ferrochrome alloy containing Cr 20–80%, Fe 15–75%, C 5–10%, Si less than 10% and Ti and Mn as other unavoidable impurities. (%=weight%)

SFA is a self-fluxing alloy whose constituents are at least one kind of metal selected from Si, B, C and one kind of metal selected from Ni, Cr, Co, W and Mo.

AF metals are metals containing at least one metal selected from Ni, Cr, Co and Fe.

Ni—Al is a nickel aluminide, a composite powder which is composed of Ni coated with 3–10% Al and/or Al coated with 60–90% Ni.

NiCr—Al is a nickel-chrome aluminide, a composite powder which is composed of NiCr (Cr 10–30%) coated with 3–10% Al.

Coarse powder is defined as a powder which has a powder diameter of 5–150 μm preferably 10–70 μm measured by an ordinary sieving method or sedimentation method, and fine powder is a powder which has a powder diameter 0.5–20 μm preferably 1–5 μm measured by Fisher Subsieve-Sizer (FSSS) and diameters of equally mixed micropelletized micropellets are 5–150 μm preferably 10–70 μm.

This inventive spray micropellets are quite different from known spray materials.

High hardness high carbon ferrochrome alloys were used only as coarse powders up to now, however it has now become possible to use high hardness high carbon ferrochrome alloys as fine powders in this invention, but it is difficult to use fine powders only as sprayed material because of operational difficulty and low deposit efficiency.

In the case of micropelletized micropellets of high hardness, high carbon ferrochrome alloys are sprayed on the sliding interface of the mechanical seal as needed and are sprayed on other sliding interface. High carbon ferrochrome alloys are distributed equally finely in the sprayed coatings of sprayed surface in this invention and this invention has good effects afterward described.

The surface roughness of sprayed materials of this invention and that of the former method after lapping are shown in Table 2.

TABLE 2

| Classification | Ra (μm) |
|---|---|
| former sprayed materials are used | 3.0 |

TABLE 2-continued

| Classification | Ra (μm) |
|---|---|
| micropellets of our invention are used | 0.2 |

where, Ra means central line mean roughness by JIS (Japanese Industrial Standard) B0601 and is measured according to the method of JIS B0651.

There exist coarse, high hardness particles in prior art sprayed materials, however, in this invention there are obtained high density coatings not containing coarse particles.

Effects of this Invention

Effects of this invention are summarized as follows:

(a) As particles of high carbon ferrochrome alloys are fine and micropelletized, rebounding and scattering are scarce and efficiency of said particles in the sprayed coatings is enhanced and said spray coatings have high wear resistance.

(b) As particles of high carbon ferrochrome alloys are fine, spray coatings having high density and no defects are obtained and said coatings have high wear resistance.

(c) As particles of high carbon ferrochrome alloys are fine, elements of high hardness are distributed equally in the sprayed coatings and said sprayed coatings have no segregation and scattering of hardness of particles, therefore said sprayed coatings have high wear resistance.

(d) In the case where several fine powders are micropelletized in the same kind of micropellet, segregation of elements and deviation of hardness in coatings become reduced, as fine powders of several kinds are contained equally in micropellets.

(e) And therefore, coarse particles of coatings can be smaller in case of lapping finishes.

(f) Scuffing resistance of coatings is enhanced by adding Mo.

(g) High density coatings having good adhesion to the substrate are enhanced by adding nickel aluminide and/or nickelchrome aluminide to micropellets.

(h) Five steps i.e. forming→sintering→sizing→setting in→finishing are necessary to produce ordinary mechanical seals. However, only 2 steps i.e. spraying→sizing are necessary in our invention and therefore products of our invention are very cheap and are produced simply.

(i) In an ordinary mechanical seal, a 2-3 mm thickness of sintered layer is necessary, however in our invention, a sintered layer of less than 1 mm thickness can produce an equal effect.

(j) Therefore, it is possible to produce cheap and high quality sliding materials and especially to produce mechanical seals by a plasma spraying method by using micropelletized micropellets in our invention.

Figure 1:
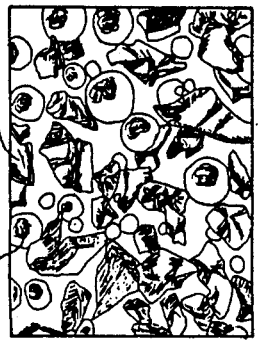
FIG. 1 is a view of spray powders heretofore in use.

This invention is illustrated as per the following drawings:

In FIG. 1, there are depicted spray powders composed of mixtures of coarse powders (13) 70% of high carbon ferrochrome alloy and coarse powders of SFA (7) 3% heretofore in use, in order to compare with the spray powders of our invention.

Figure 3:
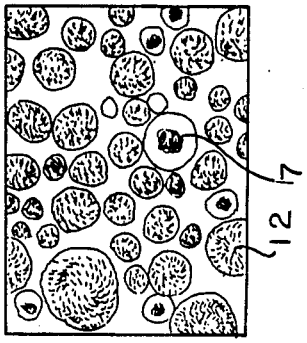

In FIG. 2–FIG. 9, there are depicted examples of this invention respectively. In FIG. 2, are indicated the same kind of spray powders composed of micropelletized micropellets which are mixtures of fine powders of high carbon ferrochrome alloys 70% with SFA 30%. In FIG. 3, are indicated 2 kinds of mixtures of spray powders composed of micropelletized micropellets (12) of fine powders of high carbon ferrochrome alloys 70% and coarse powders of SFA 30%.

Figure 4:
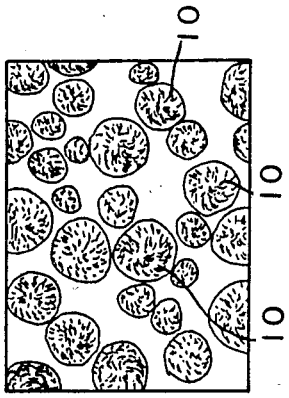

In FIG. 4, are indicated the same kind of micropelletized micropellets which are composed of mixtures of fine powders of high carbon ferrochrome alloy 70% and fine powders of Mo 15% and fine powders of SFA 15%.

Figure 7:
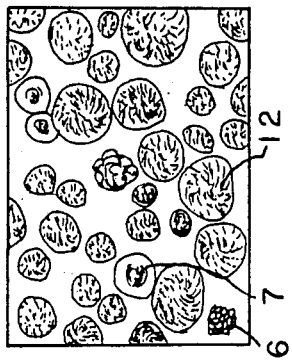
Figure 6:
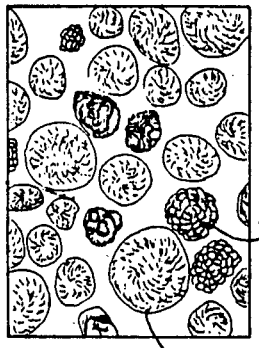
Figure 9:
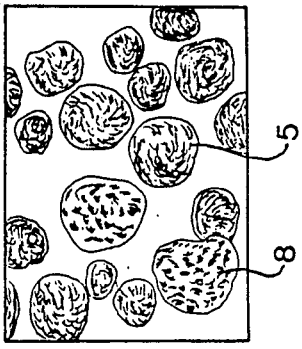
Figure 8:
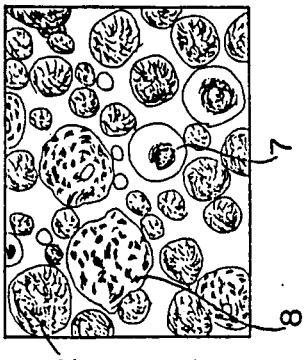
Figure 5:
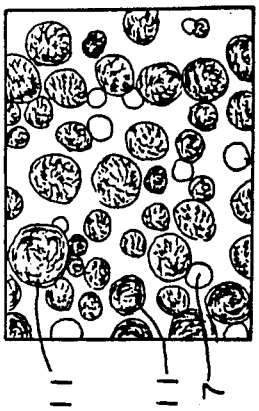

In FIG. 5, are indicated 2 kinds of mixtures of spray powders which are composed of micropelletized micropellets (11) of fine powders of high carbon ferrochrome alloy 70% mixed with fine powders of Mo 15% and coarse powders of SFA (7). In FIG. 6, are indicated 2 kinds of mixtures of spray powders which are composed of micropelletized micropellets 70% mixed with fine powders of SFA 15% and coarse powders of nickel-aluminide (6) 15%. In FIG. 7, are indicated 3 kinds of spray powders which are composed of mixtures of fine powders of micropelletized micropellets (12) of high carbon ferrochrome alloys only 70% and coarse powders of SFA 15% and coarse powders of nickel-aluminide 15%. In FIG. 8, are indicated 3 kinds of mixtures of spray powders which are composed of fine powders of micropelletized micropellets of high carbon ferrochrome alloys only 70% and micropelletized micropellets of fine powders of Mo 15% and coarse powders of SFA 15%. In FIG. 9, are indicated 2 kinds of mixtures of spray powders which are composed of micropelletized micropellets of fine powders of high carbon ferrochrome alloys 70% mixed with fine powders of SFA 15% and micropelletized micropellets of fine powders of Mo 15% only.

In FIGS. 2, 3, 4, 5, 6, 7, 8 and 9, similar results are obtained by using AF metals, which contain at least one kind of metal which is selected from a group of Ni, Cr, Co and Fe instead of SFA metals, and in FIGS. 6 and 7 similar results are obtained by using nickelchrome-aluminide instead of nickel-aluminide.

Figure 10:
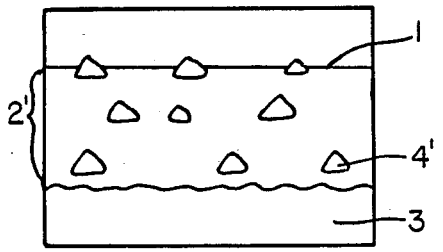
FIG. 10 is a part of enlarged sectional view of sprayed coatings sprayed with spray powders heretofore in use.
Figure 11:
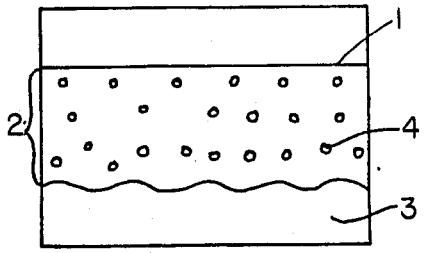
FIG. 11 is a part of enlarged sectional view of sprayed coatings sprayed with spray powders of this invention.

FIG. 10 is a enlarged drawing of a part of FIG. 1 which shows spray coatings heretofore in use, and these particle sizes of high carbon ferrochrome alloys are about 10–150 μm and FIG. 11 is a enlarged drawing of spray coatings of micropellets in use as spraying material in this invention, and the particle sizes of high carbon ferrochrome alloy are 0.5–20 μm in the sprayed coatings.

| | |
|---|---|
| (1) lapping surface | (2), (2') spray coatings |
| (3) substrate | (4), (4') high hardness particles |

TABLE 1

| No. of Invention | Composition | Form of particles | Weight % of composition | Sort of micropellets | Constituents of spray materials |
|---|---|---|---|---|---|
| 1 | Fe—Cr | fine powder | main component is Fe—Cr | micropelletized | micropellets of Fe—Cr |
| 2 | Fe—Cr | fine powder | 30–95 | | one same kind of powder |
| | SFA | fine powder | 5–70 | → mixed and micropelletized | |

TABLE 1-continued

| No. of Invention | Composition | Form of particles | Weight % of composition | Sort of micropellets | Constituents of spray materials |
|---|---|---|---|---|---|
| 3 | Fe—Cr | fine powder | 30–95 | → mixed and micropelletized | one same kind of powder |
| | AF-metals | fine powder | 5–70 | | |
| 4 | Fe—Cr | fine powder | 30–95 | → micropelletized | mixture of 2 kinds of powder |
| | SFA | coarse powder | 5–70 | → coarse powder alone | |
| 5 | Fe—Cr | fine powder | 30–95 | → micropelletized | mixture of 2 kinds of powder |
| | AF-metals | coarse powder | 5–70 | → coarse powder alone | |
| 6 | Fe—Cr | fine powder | 3–90 | → mixed and micropelletized | one same kind of powder |
| | Mo | fine powder | 5–30 | | |
| | SFA | fine powder | 5–65 | | |
| 7 | Fe—Cr | fine powder | 30–90 | → mixed and micropelletized | one same kind of powder |
| | Mo | fine powder | 5–30 | | |
| | AF-metals | fine powder | 5–65 | | |
| 8 | Fe—Cr | fine powder | 30–90 | → mixed and micropelletized | mixture of 2 kinds of powder |
| | Mo | fine powder | 5–30 | | |
| | SFA | coarse powder | 5–65 | → coarse powder alone | |
| 9 | Fe—Cr | fine powder | 30–90 | → mixed and micropelletized | mixture of 2 kinds of powder |
| | Mo | fine powder | 5–30 | | |
| | AF-metals | coarse powder | 5–65 | → coarse powder alone | |
| 10 | Fe—Cr | fine powder | 30–90 | → micropelletized | mixture of 3 kinds of powder |
| | Mo | fine powder | 5–30 | → micropelletized | |
| | SFA | coarse powder | 5–65 | → coarse powder alone | |
| 11 | Fe—Cr | fine powder | 80–90 | → micropelletized | mixture of 3 kinds of powder |
| | Mo | fine powder | 5–30 | → micropelletized | |
| | AF-metals | coarse powder | 5–65 | → coarse powder alone | |
| 12 | Fe—Cr | fine powder | 30–90 | → mixed and micropelletized | mixture of 2 kinds of powder |
| | SFA | fine powder | 5–65 | | |
| | Mo | fine powder | 5–30 | → micropelletized | |
| 13 | Fe—Cr | fine powder | 30–90 | → mixed and micropelletized | mixture of 2 kinds of powder |
| | AF-metals | fine powder | 5–65 | | |
| | Mo | fine powder | 5–30 | → micropelletized | |
| 14 | Fe—Cr | fine powder | 30–95 | → mixed and micropelletized | mixture of 2 kinds of powder |
| | SFA | fine powder | 5–65 | | |
| | Ni—Al &/or NiCr—Al | coarse powder | 5–30 | → coarse powder alone | |
| 15 | Fe—Cr | fine powder | 30–90 | → mixed and micropelletized | mixture of 2 kinds of powder |
| | AF-metals | fine powder | 5–65 | | |
| | Ni—Al &/or NiCr—Al | coarse powder | 5–30 | → coarse powder alone | |
| 16 | Fe—Cr | fine powder | 30–90 | → micropelletized | mixture of 3 kinds of powder |
| | SFA | coarse powder | 5–65 | → coarse powder alone | |
| | Ni—Al &/or NiCr—Al | coarse powder | 5–30 | → coarse powder alone | |
| 17 | Fe—Cr | fine powder | 30–90 | → micropelletized | mixture of 3 kinds of powder |
| | AF-metals | coarse powder | 5–65 | → coarse powder alone | |
| | Ni—Al &/or NiCr—Al | coarse powder | 5–30 | → coarse powder alone | |

What is claimed is:

1. Spray micropellets having a particle size of 5 to 150 μm consisting essentially of micropelletized fine powder of high carbon ferrochrome alloy having a particle size of 0.5 to 20 μm, said alloy consisting essentially of 20 to 80 wt. % Cr, 15 to 75 wt. % Fe, 5 to 10 wt. % C, less than 10 wt. % Si and Ti and Mn as unavoidable impurities.

2. The spray micropellets according to claim 1 consisting essentially of a micropelletized mixture of 30 to 95 wt.% of said fine powder of high carbon ferrochrome alloy and 5 to 70 wt. % of fine powder of self fluxing alloys having at least one component selected from the group consisting of Si, B and C and at least one component selected from the group consisting of Ni, Cr, Co, Fe, W and Mo having a particle size of 0.5 to 20 μm.

3. The spray micropellets according to claim 1 consisting essentially of a micropelletized mixture of 30 to 95 wt. % of said fine powder of high carbon ferrochrome alloy and 5 to 70 wt. % of fine powder of metals having at least one component selected from the group consisting of Ni, Cr, Co and Fe having a particle size of 0.5 to 20 μm.

4. The spray micropellets according to claim 1 consisting essentially of a mixture of 30 to 95 wt. % of said micropelletized fine powder of high carbon ferrochrome alloy and 5 to 70 wt. % of coarse powder of self fluxing alloys having at least one component selected from the group consisting of Si, B and C and at least one component selected from the group consisting of Ni, Cr, Co, Fe, W and Mo having a particle size of 5 to 150 μm.

5. The spray micropellets according to claim 1 consisting essentially of a mixture of 30 to 95 wt. % of said micropelletized fine powder of high carbon ferrochrome alloy and 5 to 70 wt. % of coarse powder of metals having at least one component selected from the group consisting of Ni, Cr, Co and Fe having a particle size of 5 to 150 μm.

6. The spray micropellets according to claim 1 consisting essentially of a micropelletized mixture of 30 to 90 wt. % of said fine powder of high carbon ferrochrome alloy, 5 to 30 wt. % of fine powder of Mo having a particle size of 0.5 to 20 μm and 5 to 65 wt. % of fine powder of self fluxing alloys having at least one component selected from the group consisting of Si, B and C and at least one component selected from the group consisting of Ni, Cr, Co, Fe, W and Mo having a particle size of 0.5 to 20 μm.

7. The spray micropellets according to claim 1 consisting essentially of a micropelletized mixture of 30 to 90 wt. % of said fine powder of high carbon ferrochrome alloy, 5 to 30 wt. % of fine powder of Mo having a particle size of 0.5 to 20 μm and 5 to 65 wt. % of fine powder of metals having at least one component selected from the group consisting of Ni, Cr, Co and Fe having a particle size of 0.5 to 20 μm.

8. The spray micropellets according to claim 1 consisting essentially of a mixture of (a) a micropelletized mixture of said fine powder of high carbon ferrochrome alloy and fine powder of Mo having a particle size of 0.5 to 20 μm and (b) coarse powder of self fluxing alloys having at least one component selected from the group consisting of Si, B and C and at least one component selected from the group consisting of Ni, Cr, Co, Fe, W and Mo having a particle size of 5 to 150 μm, said high carbon ferrochrome alloy being present at 30 to 90 wt. %, said Mo being present at 5 to 30 wt. % and said self fluxing alloys having at least one component selected from the group consisting of Si, B and C and at least one component selected from the group consisting of Ni, Cr, Co, Fe, W and Mo being present at 5 to 65 wt. % in said micropellets.

9. The spray micropellets according to claim 1 consisting essentially of a mixture of (a) a micropelletized mixture of said fine powder of high carbon ferrochrome alloy and fine powder of Mo having a particle size of 0.5 to 20 μm and (b) coarse powder of metals having at least one component selected from the group consisting of Ni, Cr, Co and Fe having a particle size of 5 to 150 μm, said high carbon ferrochrome alloy being present at 30 to 90 wt. %, said Mo being present at 5 to 30 wt. % and said metals having at least one component selected from the group consisting of Ni, Cr, Co and Fe being present at 5 to 65 wt. % in said micropellets.

10. The spray micropellets according to claim 1 consisting essentially of a mixture of 30 to 90 wt. % of said micropelletized fine powder of high carbon ferrochrome alloy, 5 to 30 wt. % of micropelletized fine powder of Mo having a particle size of 0.5 to 20 μm and 5 to 65 wt.% of coarse powder of self fluxing alloys having at least one component selected from the group consisting of Si, B and C and at least one component selected from the group consisting of Ni, Cr, Co, Fe, W and Mo having a particle size of 5 to 150 μm.

11. The spray micropellets according to claim 1 consisting essentially of a mixture of 30 to 90 wt. % of said micropelletized fine powder of high carbon ferrochrome alloy, 5 to 30 wt. % of micropelletized fine powder of Mo having a particle size of 0.5 to 20 μm and 5 to 65 wt.% of coarse powder of metals having at least one component selected from the group consisting of Ni, Cr, Co and Fe having a particle size of 5 to 150 μm.

12. The spray micropellets according to claim 1 consisting essentially of a mixture of (a) a micropelletized mixture of said fine powders of high carbon ferrochrome alloy and fine powder of self fluxing alloys having at least one component selected from the group consisting of Si, B and C and at least one component selected from the group consisting of Ni, Cr, Co, Fe, W and Mo having a particle size of 0.5 to 20 μm and (b) micropelletized fine powder of Mo having a particle size of 0.5 to 20 μm, said fine powder of high carbon ferrochrome alloy being present at 30 to 90 wt. %, said fine powder of self fluxing alloys having at least one component selected from the group consisting of Si, B and C and at least one component selected from the group consisting of Ni, Cr, Co, Fe, W and Mo being present at 5 to 65 wt. % and said fine powder of Mo being present at 5 to 30 wt. % in said micropellets.

13. The spray micropellets according to claim 1 consisting essentially of a mixture of (a) a micropelletized mixture of said fine powders of high carbon ferrochrome alloy and fine powder of metals having at least one component selected from the group consisting of Ni, Cr, Co and Fe having a particle size of 0.5 to 20 μm and (b) micropelletized fine powder of Mo having a particle size of 0.5 to 20 μm, said fine powder of high carbon ferrochrome alloy being present at 30 to 90 wt. %, said fine powder of metals having at least one component selected from the group consisting of Ni, Cr, Co and Fe being present at 5 to 65 wt. % and said fine powder of Mo being present at 5 to 30 wt. % in said micropellets.

14. The spray micropellets according to claim 1 consisting essentially of a mixture of (a) a micropelletized mixture of said fine powder of high carbon ferrochrome alloy and fine powder self fluxing alloys having at least one component selected from the group consisting of Si, B and C and at least one component selected from the group consisting of Ni, Cr, Co, Fe, W and Mo having a particle size of 0.5 to 20 μm and (b) coarse powder Ni—Al and/or NiCr—Al, said coarse powder having a particle size of 5 to 150 μm, said fine powder of high carbon ferrochrome alloy being present at 30 to 90 wt. %, said fine powder of self fluxing alloys having at least one component selected from the group consisting of Si, B and C and at least one component selected from the group consisting of Ni, Cr, Co, Fe, W and Mo being present at 5 to 65 wt. % and said Ni—Al and/or NiCr—Al being present at 5 to 30 wt. % in said micropellets.

15. The spray micropellets according to claim 1 consisting essentially of a mixture of (a) a micropelletized mixture of said fine powder of high carbon ferrochrome alloy and fine powder metals having at least one component selected from the group consisting of Ni, Cr, Co and Fe having a particles size of 0.5 to 20 μm and (b) coarse powder Ni—Al and/or NiCr—Al, said coarse powder having a particle size of 5 to 150 μm, said fine powder of high carbon ferrochrome alloy being present at 30 to 90 wt. %, said fine powder of metals having at least one component selected from the group consisting of Ni, Cr, Co and Fe being present at 5 to 65 wt. % and said Ni—Al and/or NiCr—Al being present at 5 to 30 wt. % in said micropellets.

16. The spray micropellets according to claim 1 consisting essentially of a mixture of 30 to 90 wt. % of said micropelletized fine powder of high carbon ferrochrome alloy, 5 to 65 wt. % of coarse powder of self fluxing alloys having at least one component selected from the group consisting of Si, B and C and at least one component selected from the group consisting of Ni, Cr, Co, Fe, W and Mo having a particle size of 5 to 150 μm and 5 to 30 wt. % of coarse powder of Ni—Al and/or NiCr—Al having a particle size of 5 to 150 μm.

17. The spray micropellets according to claim 1 consisting essentially of a mixture of 30 to 90 wt. % of said micropelletized fine powder of high carbon ferrochrome alloy, 5 to 65 wt. % of coarse powder of metals having at least one component selected from the group consisting of Ni, Cr, Co and Fe having a particle size of 5 to 150 μm and 5 to 30 wt. % of coarse powder of Ni—Asl and/or NiCr—Al having a particle size of 5 to 150 μm.

* * * * *